US007115029B2

(12) United States Patent
Lang et al.

(10) Patent No.: US 7,115,029 B2
(45) Date of Patent: Oct. 3, 2006

(54) ABRASIVE CUTTING DISK WITH LATERAL STEEL SHEETS

(75) Inventors: Adolf Lang, Schwaz (AT); Florian Meissl, Innsbruck (AT); Markus Bosin, Kitzbühel (AT)

(73) Assignee: Tyrolit Schleifmittelwerke Swarovski KG., Schwag (AT)

( * ) Notice: Subject to any disclaimer, the term of this patent is extended or adjusted under 35 U.S.C. 154(b) by 8 days.

(21) Appl. No.: 10/472,572

(22) PCT Filed: Jan. 23, 2003

(86) PCT No.: PCT/AT03/00022

§ 371 (c)(1),
(2), (4) Date: Sep. 24, 2003

(87) PCT Pub. No.: WO03/061910

PCT Pub. Date: Jul. 31, 2003

(65) Prior Publication Data

US 2005/0107020 A1 May 19, 2005

(30) Foreign Application Priority Data

Jan. 24, 2002 (EP) ..... 02001641

(51) Int. Cl.
*B23F 21/03* (2006.01)

(52) U.S. Cl. ..... 451/544; 451/546

(58) Field of Classification Search ..... 451/540, 451/541, 546, 544, 548, 543, 342
See application file for complete search history.

(56) References Cited

U.S. PATENT DOCUMENTS

| | | | | |
|---|---|---|---|---|
| 1,600,064 | A | 9/1926 | Perks | |
| 1,756,259 | A * | 4/1930 | Perks | 451/342 |
| 2,004,630 | A * | 6/1935 | Krug | 451/546 |
| 2,033,263 | A | 3/1936 | Tone | |
| 2,259,554 | A * | 10/1941 | Clark | 451/342 |
| 3,526,063 | A * | 9/1970 | Cook | 451/546 |
| 3,528,203 | A * | 9/1970 | Franklin et al. | 451/342 |
| 3,838,543 | A * | 10/1974 | Lakhani | 451/546 |
| 3,867,795 | A * | 2/1975 | Howard | 451/548 |
| 3,898,773 | A | 8/1975 | Bogusch | |
| 4,718,398 | A | 1/1988 | Hallez | |
| 6,749,496 | B1 * | 6/2004 | Mota et al. | 451/546 |

FOREIGN PATENT DOCUMENTS

| | | |
|---|---|---|
| JP | 57089564 | 6/1982 |
| JP | 06312314 | 11/1994 |
| WO | 99/61204 | 12/1999 |

* cited by examiner

*Primary Examiner*—Dung Van Nguyen
(74) *Attorney, Agent, or Firm*—Wenderoth, Lind & Ponack, L.L.P.

(57) ABSTRACT

Cutting-off wheel (1), in particular with a diameter above 500 mm, which is provided laterally with steel sheets or steel grids (2) with a minimum thickness of 0.5 mm.

19 Claims, 3 Drawing Sheets

ABRASIVE CUTTING DISK WITH LATERAL STEEL SHEETS

BACKGROUND OF THE INVENTION

The present invention relates to a cutting-off wheel, with a diameter above 500 mm, which can be clamped between clamping flanges, with a mixture of abrasive grain, binder and optionally fillers, which extends from the outer edge of the cutting-off wheel up to the central bore, the cutting-off wheel being provided laterally with steel sheets or steel grids.

Cutting-off wheels with large diameters are used in the metal-producing industry, where, for example in steel works or foundries, slabs are cut. In this connection it is favourable to keep the wheel thickness of the cutting-off wheel as low as possible in order to keep the cutting losses of the high-quality and expensive metal materials low. In addition, a low wheel thickness means that the power requirement of the cutting-off machine falls as a result of which less load is placed on all mechanical and electrical components of the cutting-off machine with the same cutting-off results.

By reducing the wheel thickness the problem then arises that wheels which are very thin relative to their diameter have a tendency to wobble. In order to avoid this wobbling, attempts were made on the one hand to increase the diameter of the clamping flanges in order to stabilize the cutting-off wheels radially further out. The enlargement of the clamping flanges leads however to a reduction of the possible depth of cut as well as to greater moving masses.

In a second approach attempts were made for example with the abrasive wheels shown in JP 57 089 564 or U.S. Pat. No. 4,718,398 to fit an annular abrasive area externally onto an exclusively metallic internal area of the cutting-off wheel. The problem of a stable and lasting combination of metallic internal area and external abrasive area could not however be satisfactorily solved to date.

The abrasive wheel shown in U.S. Pat. No. 1,600,064 has lateral supports equal in area to the clamping flanges. These supports are thus not capable of distributing the clamping forces over a large area beyond the clamping flanges. A radial enlargement of the supports shown in U.S. Pat. No. 1,600,064 would result in a reduction of the possible depth of cut.

SUMMARY OF THE INVENTION

The object of the present invention is therefore to create a cutting-off wheel which runs in a stable manner in spite of a wheel thickness which is low compared with the diameter, wherein the problems of the known approaches are avoided at the same time.

This is achieved according to the invention in that the steel sheets or steel grids are housed flush in recesses in the side surfaces of the cutting-off wheel and have a minimum thickness of 0.5 mm and a radial extension exceeding the radial extension of the clamping flanges.

The steel sheets or steel grids inserted laterally flush into the axial end surfaces of the cutting-off wheel lead to an extensive distribution of the clamping forces originating from the clamping flanges. As the steel sheets or steel grids extend further outwards radially than the clamping flanges, the cutting-off wheel is stabilized over a large area. Due to the flush embedding of the steel sheets or steel grids, which ensures an unchanged depth of cut up to the clamping flanges, a sufficient minimum thickness of at least 0.5 mm can be selected which ensures an optimum distribution of forces.

In order to ensure an optimum transfer of the clamping forces it is favourable if the steel sheets or steel grids are glued to the cutting-off wheel. The steel sheets or steel grids can thus also optimally absorb the bending loads occurring in the peripheral zones of the cutting-off wheel so that wobbling is effectively prevented.

For smooth circulation properties of the cutting-off wheel it is favourable if the steel sheets or steel grids have an essentially round shape.

In the interests of a further stabilizing of the cutting-off wheel the latter can have at least one woven fabric insert in a manner known per se.

The process according to the invention provides that firstly a steel sheet or steel grid with a minimum thickness of 0.5 mm and with an extension exceeding the radial extension of a clamping flange is laid on a pressing plate, the mixture of abrasive grain, binder and optionally fillers is then applied and finally compacted, so that the steel sheet or steel grid is inserted flush into the side surface. This production process is particularly favourable in terms of production and at the same time ensures that the steel sheets or steel grids are held securely.

This hold can still be further improved by providing the steel sheets or steel grids, before they are pressed on the side facing the cutting-off wheel, with an adhesive, in particular epoxide adhesive.

BRIEF DESCRIPTION OF THE SEVERAL VIEWS OF THE DRAWING

Further features and details of the present invention result from the following description of the figures. There is shown in FIG. 1 an exploded representation of a cutting-off wheel according to the invention, FIG. 2 a section through the cutting-off wheel along the line A—A in FIG. 3 and FIG. 3 a side view of the cutting-off wheel.

DETAILED DESCRIPTION OF THE INVENTION

Figure 1:
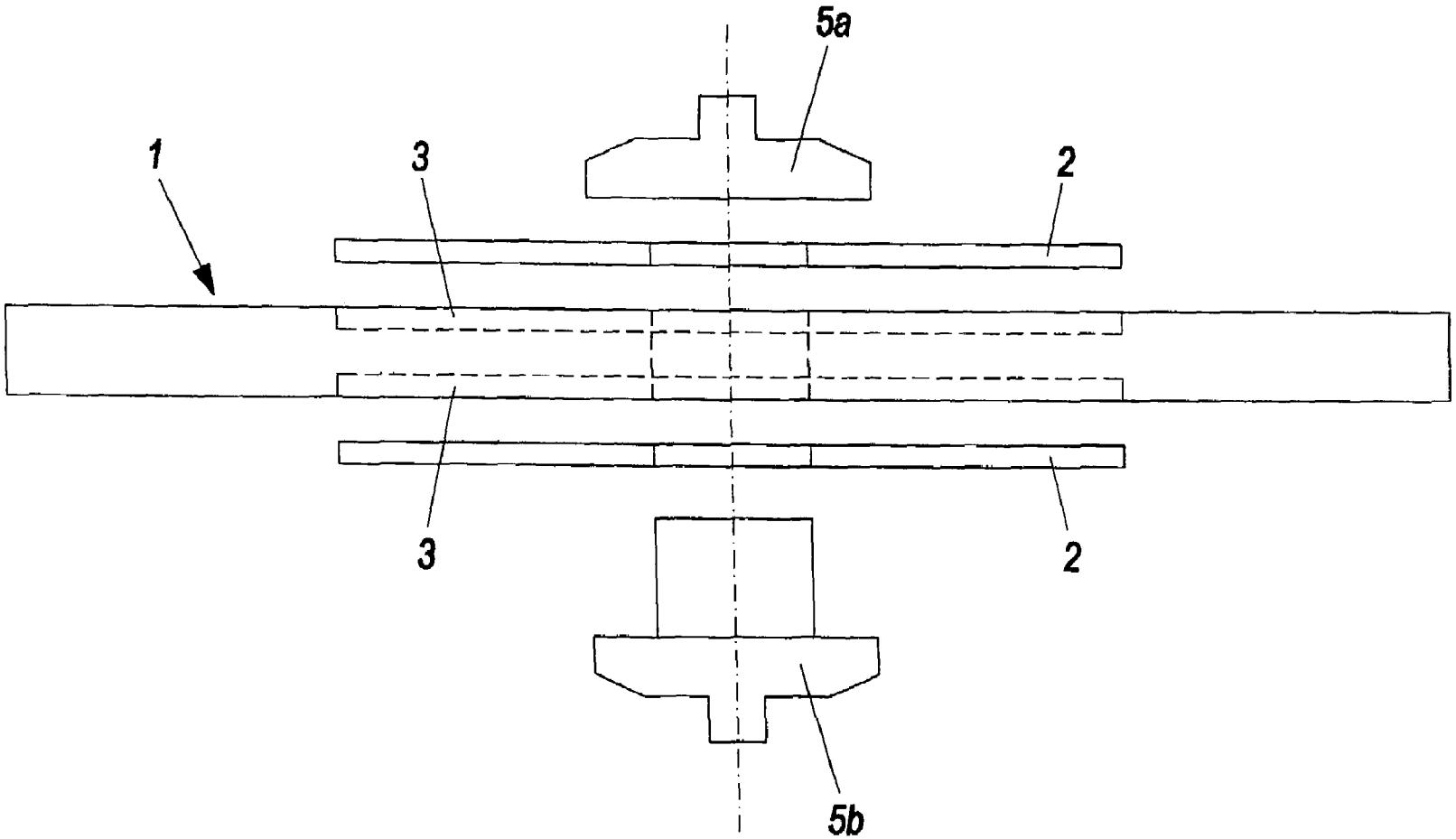

The cutting-off wheel 1 represented in the Figures is a synthetic-resin-bonded abrasive wheel. Different phenol resins are used as synthetic resin, the targeted selection of which together with the selection of the abrasive and the fillers, ensures that the abrasion behaviour and the degree of hardness of the cutting-off wheel is adapted to the respective requirements.

Conventional abrasives such as silicon carbide and corundum are preferably used as abrasives. Solid lubricants, for example pyrite and graphite, primarily serve as fillers, as well as customary powdered materials for strengthening plastic such as calcium carbonate or glass powder.

The diameter d of the cutting-off wheel 1 typically lies between 800 mm and 1800 mm. The proportionality of diameter d to the width b lies above 80, preferably even above 100. This proportionality is to be increased even further on the basis of the present invention. It may be mentioned that the width b of the cutting-off wheel 1, for reasons of clarity, is drawn many times larger relative to the diameter d.

The cutting-off wheel 1 has recesses 3 in the lateral end surfaces, which recesses extend over a diameter range of the diameter d of 45% to 80%. The steel sheets or steel grids 2 are inserted essentially flush into the recesses 3.

The steel sheets or steel grids 2 have a minimum thickness of 0.5 mm and can be up to 3.0 mm thick, customary values lying rather between 1.0 mm and 2.0 mm. The steel sheets form a closed surface, whereas steel grids are understood to mean structures which have recesses, in particular square recesses. The steel sheets or steel grids 2 are glued to the other cutting-off wheel 1.

Figure 3:
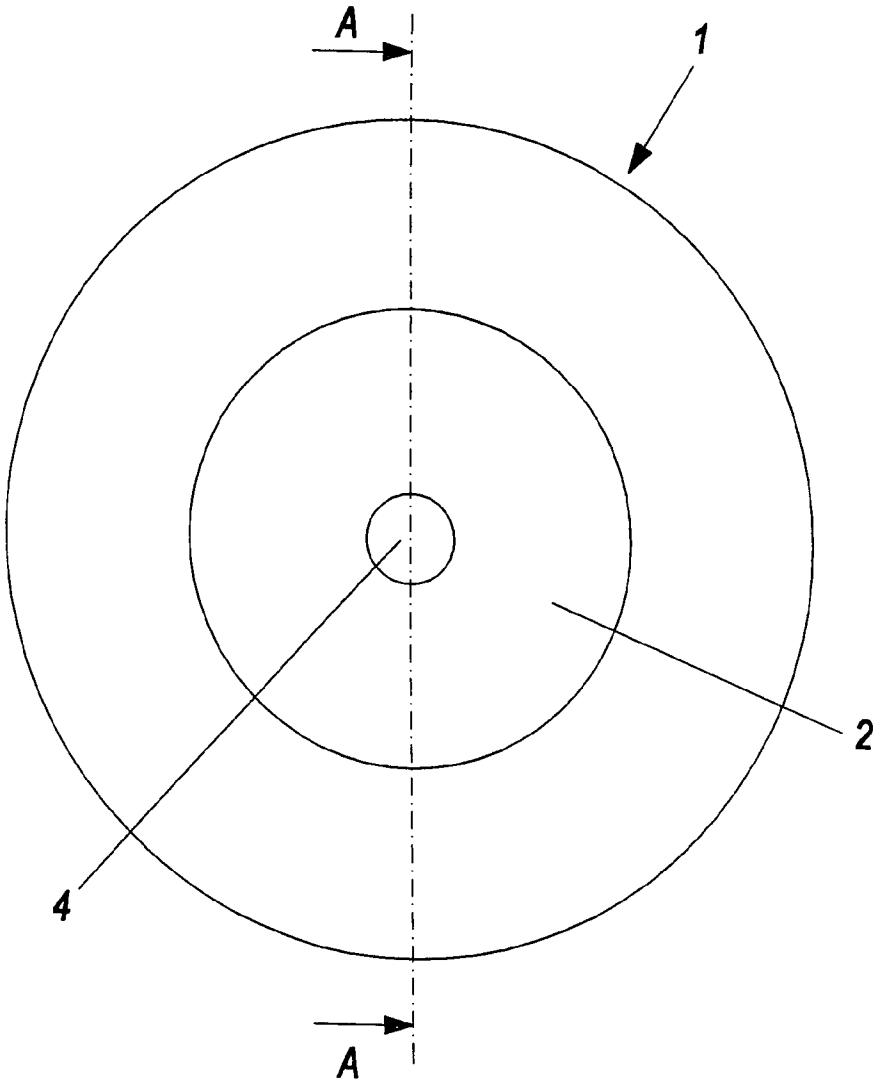

The steel sheets 2 are round in the embodiment shown, as is clear from FIG. 3. Even if the round shape is favourable for smooth circulation properties, any other shape can also be considered, in particular polygonal shapes.

In FIG. 1 the two co-operating clamping flanges 5*a* and 5*b* with which the transfer of forces to the cutting-off wheel 1 takes place are shown. The steel sheets or steel grids 2 mean that the force is conducted not only to the area of the clamping flanges 5*a* and 5*b* but extends essentially over the entire area covered by the steel sheets or steel grids 2. The stabilizing of the cutting-off wheel 1 thus extends radially far outwards.

Figure 2:
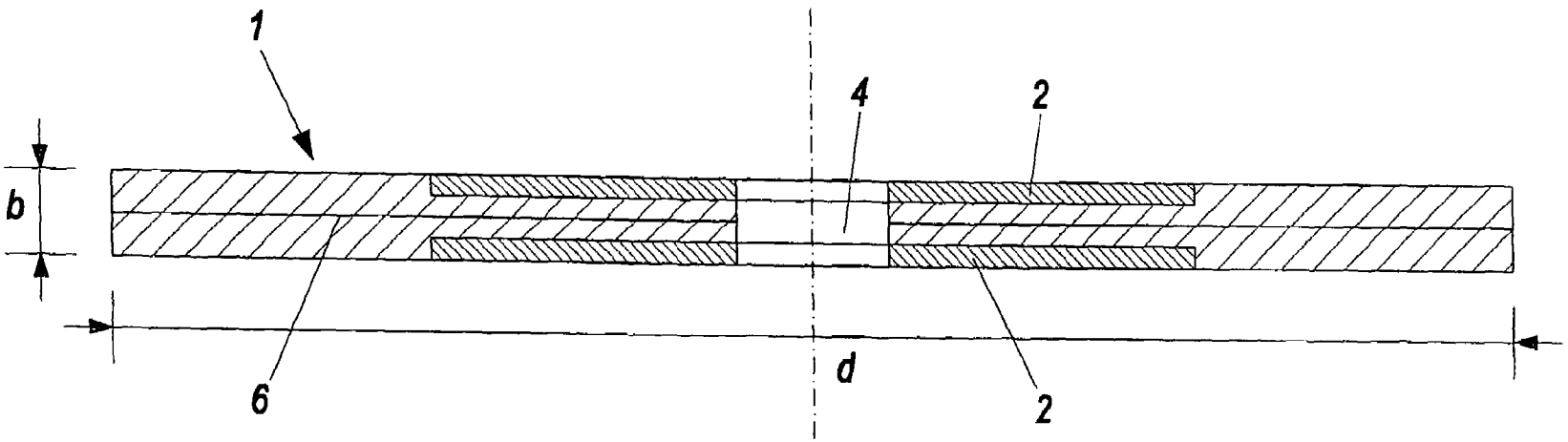

In FIG. 2 it can be seen that the cutting-off wheel 1 has a woven fabric insert 6. This is a resin-impregnated glass cloth. The woven fabric insert 6 stabilizes the cutting-off wheel 1 and prevents the occurrence of stray fragments of wheel if the wheel breaks down. The present invention makes it possible to manage with only one or at least few woven fabric inserts 6. A variant without woven fabric insert is also conceivable. This is advantageous to the extent that by reducing the fabric layers the volume of the fabric can be replaced by abrasive grain, as a result of which the abrasion properties are improved.

The production of cutting-off wheels according to the invention proceeds such that a mixture is produced from abrasive grain, synthetic resin and fillers. A steel sheet or steel grid 2 is placed on a round pressing plate and the mixture of abrasive grain, synthetic resin and fillers is then applied. The woven fabric inserts 6 are introduced into this mixture. This is then compacted, a recess 3 being formed on the surface. The second steel sheet or steel grid 2 is inserted into this recess 3, after which a renewed pressing occurs. The steel sheets or steel grids 2 are provided with an epoxide resin before the processing on the side facing the cutting-off wheel 1.

The pressed sandwich is then clamped between surface plates and is cured in a furnace at a suitable temperature.

The invention claimed is:

1. A cutting-off wheel with a diameter above 500 mm, which can be clamped between clamping flanges, with a mixture of abrasive grain, binder and optionally fillers, which extends from the outer edge of the cutting-off wheel up to the central bore, the cutting-off wheel being provided laterally with steel sheets or steel grids, wherein the steel sheets or steel grids are housed flush in recesses in the side surfaces of the cutting-off wheel and have a minimum thickness of 0.5 mm and a radial extension exceeding the radial extension of the clamping flanges, wherein the steel sheets or steel grids are glued to the cutting-off wheel.

2. The cutting-off wheel according to claim 1, wherein the thickness of the steel sheets or steel grids is between 0.5 mm and 3.0 mm.

3. The cutting-off wheel according to claim 2, wherein the thickness of the steel sheets or steel grids is between 1.0 mm and 2.0 mm.

4. The cutting-off wheel according to claim 1, wherein the steel sheets or steel grids have an essentially round shape.

5. The cutting-off wheel according to claim 1, wherein the radial extension of the steel sheets or steel grids extends from the central bore to at most 80% of the diameter of the cutting-off wheel.

6. The cutting-off wheel according to claim 1, wherein the proportionality of the diameter of the cutting-off wheel to the width of the cutting-off wheel lies above 80.

7. The cutting-off wheel according to claim 1, wherein the cutting-off wheel contains synthetic resin as binder.

8. The cutting-off wheel according to claim 1, wherein the cutting-off wheel contains at least one woven fabric insert.

9. A process for producing a cutting-off wheel with a diameter above 500 mm, wherein a steel sheet or steel grid with a minimum thickness of 0.5 mm and with an extension exceeding the radial extension of at least two clamping flanges is laid onto a pressing plate, a mixture of abrasive grain, binder and optionally fillers is then applied and finally compacted, so that the steel sheet or steel grid is inserted flush into a side surface of the plate, wherein, upon compaction, a recess is formed into which the second steel sheet or steel grid is pressed, wherein the steel sheets or steel grids are provided with an epoxide adhesive before being pressed on the side of the plate facing the mixture of abrasive grain, binder and optionally fillers.

10. The process according to claim 9, wherein the thickness of the steel sheets or steel grids is between 0.5 mm and 3.0 mm.

11. The process according to claim 10, wherein the thickness of the steel sheets or steel grids is between 1.0 mm and 2.0 mm.

12. A process for producing a cutting-off wheel with a diameter above 500 mm, wherein a steel sheet or steel grid with a minimum thickness of 0.5 mm and with an extension exceeding the radial extension of at least two clamping flanges is laid onto a pressing plate, a mixture of abrasive grain, binder and optionally fillers is then applied and finally compacted, wherein, upon compaction, a recess is formed into which the second steel sheet or steel grid is pressed so that the steel sheets or steel grids are inserted flush into side surfaces of the plate, wherein the steel sheets or steel grids are glued to the pressing plate.

13. The process according to claim 12, wherein the steel sheets or steel grids have an essentially round shape.

14. The process according to claim 12, wherein the radial extension of the steel sheets or steel grids extends from the central bore to at most 80% of the diameter of the cutting-off wheel.

15. The process according to claim 12, wherein the proportionality of the diameter of the cutting-off wheel to the width of the cutting-off wheel lies above 80.

16. The process according to claim 12, wherein the cutting-off wheel contains synthetic resin as binder.

17. The process according to claim 12, wherein the cutting-off wheel contains at least one woven fabric insert.

18. The process according to claim 12, wherein the thickness of the steel sheets or steel grids is between 0.5 mm and 3.0 mm.

19. The process according to claim 18, wherein the thickness of the steel sheets or steel grids is between 1.0 mm and 2.0 mm.

* * * * *